US008961232B2

(12) United States Patent
Wang

(10) Patent No.: US 8,961,232 B2
(45) Date of Patent: Feb. 24, 2015

(54) ELECTRICAL CONNECTOR WITH MODULATION MODULE

(71) Applicant: Emcom Technology Inc., Taipei (TW)

(72) Inventor: Chu-Li Wang, Taipei (TW)

(73) Assignee: Emcom Technology Inc., Taipei (TW)

( * ) Notice: Subject to any disclaimer, the term of this patent is extended or adjusted under 35 U.S.C. 154(b) by 64 days.

(21) Appl. No.: 13/784,812

(22) Filed: Mar. 4, 2013

(65) Prior Publication Data

US 2013/0273777 A1 Oct. 17, 2013

Related U.S. Application Data

(60) Provisional application No. 61/625,169, filed on Apr. 17, 2012.

(51) Int. Cl.

| | |
|---|---|
| ***H01R 13/66*** | (2006.01) |
| ***H01R 13/719*** | (2011.01) |
| ***H01R 13/6461*** | (2011.01) |
| *H01R 24/64* | (2011.01) |

(52) U.S. Cl.

CPC ..... *H01R 13/719* (2013.01); *H01R 13/6461* (2013.01); *H01R 24/64* (2013.01); *Y10S 439/941* (2013.01)

USPC ..... 439/620.01; 439/941

(58) Field of Classification Search

CPC .. H01R 13/719; H01R 13/6461; H01R 24/64; Y10S 439/941

USPC ..... 439/620.01, 676, 941

See application file for complete search history.

(56) References Cited

U.S. PATENT DOCUMENTS 8,167,661 B2 * 5/2012 Straka et al. ..... 439/676

* cited by examiner

*Primary Examiner* — Javaid Nasri

(74) *Attorney, Agent, or Firm* — Cheng-Ju Chiang

(57) ABSTRACT

An electrical connector includes a plurality of channels and at least one module. The channels transmit a plurality of electrical signals, wherein each channel generates at least one crosstalk coupling with the other channels; the at least one crosstalk coupling varies with frequency. The crosstalk couplings between the channels are added as a crosstalk coupling sum. Each modulation module is connected with the channels, and the at least one modulation module adjusts the at least one crosstalk coupling to decrease the crosstalk coupling sum according to the relation between the at least one crosstalk coupling and the other crosstalk couplings.

19 Claims, 11 Drawing Sheets

ELECTRICAL CONNECTOR WITH MODULATION MODULE

BACKGROUND OF THE INVENTION

1. Field of the Invention

The present invention relates generally to an electrical connector; particularly, the present invention relates to an electrical connector of decreasing the crosstalk coupling over the full frequency range and enhancing the signal quality.

2. Description of the Prior Art

In general, high frequency signals are transmitted through connecting cables and connectors, wherein the connector has a plug and a jack. Particularly, the plug includes a plurality of metal wires, which are arranged in parallel. Please refer to FIG. 1; FIG. 1 is a schematic view of a partial circuit of the plug. As shown in FIG. 1, the plug 11 includes a first conducting wire 12, a second conducting wire 13, a third conducting wire 14, and a fourth conducting wire 15, wherein the terminal resistor 25 is connected with the first conducting wire 12 and the fourth conducting wire 15 in series; the terminal resistor 34 is connected with second conducting wire 13 and the third conducting wire 14 in series. It is noted that the first conducting wire 12 and the fourth conducting wire 15 are a differential signal pair, and the second conducting wire 13 and the third conducting wire 14 are another differential signal pair.

In practical applications, the high frequency signals are respectively transmitted in the first, second, third, and fourth conducting wires 12 to 15. However, because the spacing between the conducting wires is very small, the high frequency signals of different conducting wires will generate crosstalk coupling. Particularly, the crosstalk coupling exists in the circuit as coupling capacitor, coupling inductor, or coupling resistor, especially as coupling capacitor. As shown in FIG. 1, the coupling capacitor 16 exists between the first conducting wire 12 and the second conducting wire 13; the coupling capacitor 17 exists between the first conducting wire 12 and the third conducting wire 14; the coupling capacitor 18 exists between the second conducting wire 13 and the fourth conducting wire 15; the coupling capacitor 19 exists between the third conducting wire 14 and the fourth conducting wire 15. In addition, once the transmission rate of high frequency signal increases, the values of the coupling capacitors 16 to 19 will also increase to affect the integrity of the high frequency signals.

It is noted that researchers usually utilize the compensation vector method to decrease the crosstalk coupling. In practical applications, the compensation vector method will cause the phase difference between the vectors, so that the researchers need to utilize additional compensation vector to cancel the phase difference. However, the compensation vector method merely decreases the crosstalk of certain frequency or narrow-band region and hard to solve the crosstalk coupling problem of broadband region.

Please refer to FIG. 2; FIG. 2 is a diagram of the crosstalk coupling magnitude of the plug before and after compensation. As shown in FIG. 2, the plug crosstalk coupling magnitude 11A of high frequency is higher than that of low frequency. In addition, the compensated crosstalk coupling magnitude 11B is more effective in lower frequency (0~200 MHz), but hard to decrease the crosstalk coupling magnitude in high frequency (300~500 MHz).

For the above reasons, it is an object to design an electrical connector for decreasing the crosstalk coupling over the full frequency range.

SUMMARY OF THE INVENTION

In view of prior art, the present invention provides an electrical connector having filter units to effectively decrease the crosstalk coupling.

It is an object of the present invention to provide an electrical connector, which adjusts the frequency response between the electrical signal and the crosstalk coupling to decrease the crosstalk coupling sum.

It is an object of the present invention to provide an electrical connector, which utilizes a modulation module to adjust the crosstalk coupling sum.

It is an object of the present invention to provide an electrical connector, which utilizes a plurality of filter units, wherein the filter units are filter components and form at least one modulation module to adjust the crosstalk coupling sum.

The present invention provides an electrical connector including a plurality of channels and at least one module. In an embodiment, the channels transmit a plurality of electrical signals, wherein each channel generates at least one crosstalk coupling with the other channels, the at least one crosstalk coupling varies with frequency, and the crosstalk couplings between the channels are added as a crosstalk coupling sum.

In addition, each modulation module is connected with the channels, and the at least one modulation module adjusts the at least one crosstalk coupling to decrease the crosstalk coupling sum according to the relation between the at least one crosstalk coupling and the other crosstalk couplings. It is noted that each crosstalk coupling has at least one crosstalk coupling-frequency curve, and when the crosstalk-frequency curves are overlapped to each other, the crosstalk coupling sum approaches to 0.

The present invention provides an electrical connector including a plurality of channels and at least one filter unit. In practical applications, the channels transmit a plurality of electrical signals and include a first channel, a second channel, a third channel, and a fourth channel, wherein each channel generates at least one crosstalk coupling with the other channels, the at least one crosstalk coupling varies with frequency and has an electrical connecting end, and the crosstalk couplings between the channels are added as a crosstalk coupling sum.

It is noted that the filter unit is connected to the channels and includes at least one first filter unit and at least one second filter unit, wherein the at least one first filter unit and the at least one second filter unit are connected to the first channel and the fourth channel to form a first modulation module, the at least one first filter unit and the at least one second filter unit are connected to the second channel and the third channel to form a second modulation module, and the at least one filter unit adjusts the at least one crosstalk coupling to decrease the crosstalk coupling sum according to the relation between the at least one crosstalk coupling and the other crosstalk couplings. In addition, the electrical connecting ends of the first channel, the second channel, the third channel, and the fourth channel are disposed according to a first sequence or a second sequence.

Compared to prior arts, the electrical connector of the present invention utilizes the at least one filter unit or the least one modulation module connected to the channels and disposed in circuit according to the relative relation between the crosstalk coupling and the other crosstalk couplings, further decreasing the effect from the crosstalk couplings. In practical applications, the at least one filter unit or the at least one modulation module not only effectively decreases the crosstalk coupling in low frequency, but also has an obvious effect in high frequency. In addition, a modified embodiment of the circuit further discloses the present invention having the advantage of low cost and enhanced signal transmission quality.

The detailed descriptions and the drawings thereof below provide further understanding about the advantage and the spirit of the present invention.

DETAILED DESCRIPTION OF THE PREFERRED EMBODIMENT

According to an embodiment of the present invention, an electrical connector is provided to effectively adjust the crosstalk coupling. In the embodiment, the electrical connector can be an electrical connector used in a plurality of network transmission lines, but is not limited to the embodiment.

Figure 1:
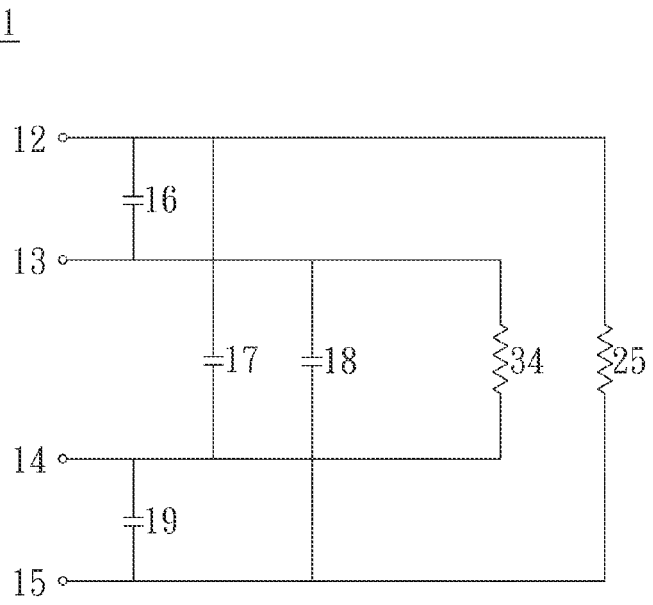
FIG. 1 (PRIOR ART)
FIG. 1 is a schematic view of a partial circuit of the conventional connector plug.
Figure 2:
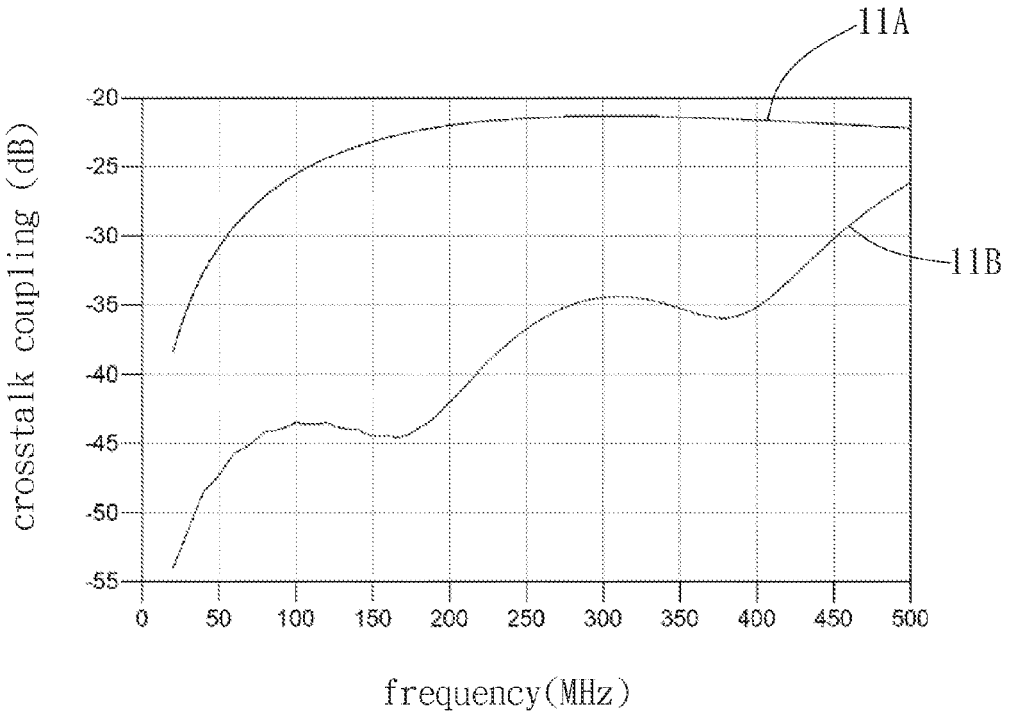
FIG. 2 (PRIOR ART)
FIG. 2 is a diagram of the crosstalk coupling magnitude of the conventional connector plug before and after compensation.
Figure 3:
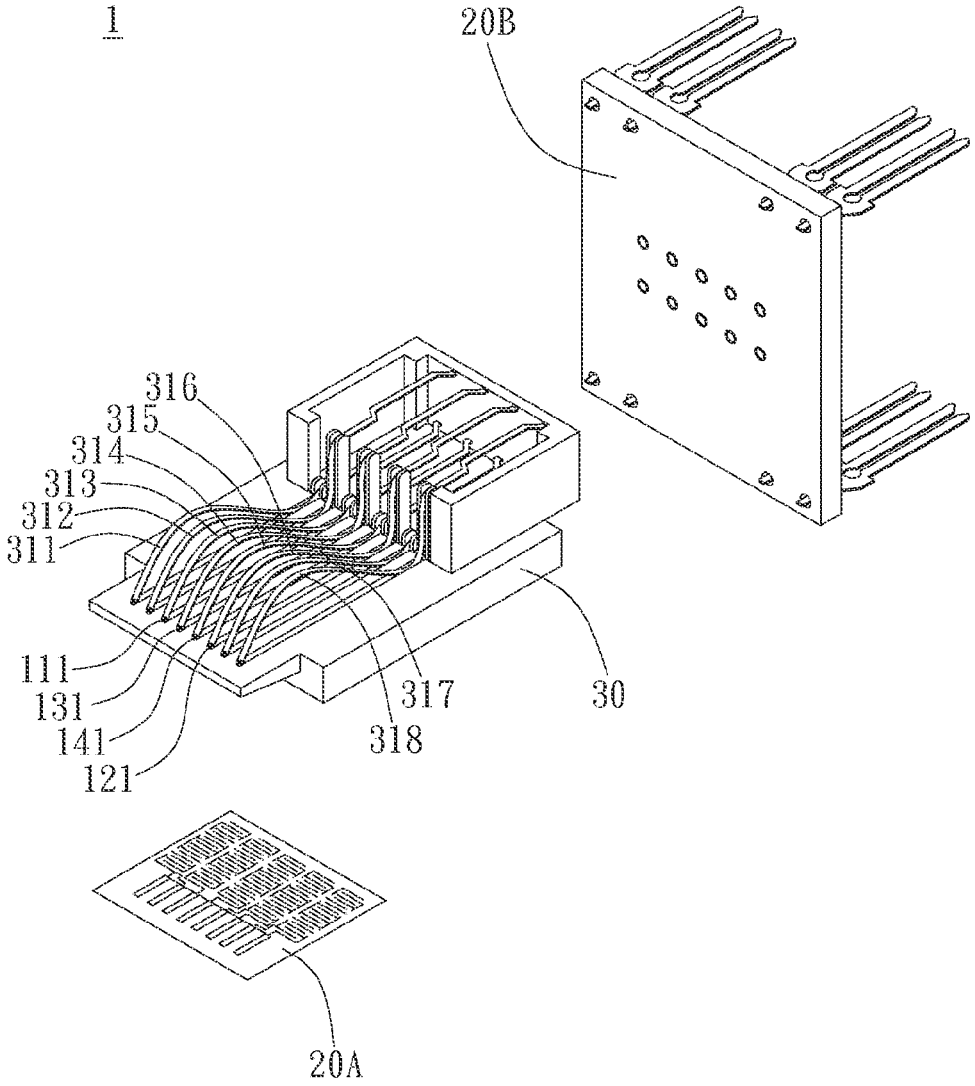
FIG. 3 is a schematic view of an embodiment of the electrical connector of the present invention.

Please refer to FIG. 3; FIG. 3 is a schematic view of an embodiment of the electrical connector of the present invention. As shown in FIG. 3, the electrical connector 1 includes at least one circuit module (e.g. two circuit modules 20A/20B), a plurality of channels (e.g. 110 to 140 shown in FIG. 4), and a body 30. In the embodiment, the body 30 is connected with the circuit modules 20A/20B and includes a plurality of conducting wires 311 to 318, wherein the channels are disposed in the conducting wires, and the circuit modules 20A/20B are connected with the channels. In practical applications, the electrical connector 1 is a network connector and is preferably an RJ45 connector, but is not limited to the embodiment.

As shown in FIG. 3, the body 30 includes eight conducting wires 311 to 318, wherein the conducting wires are disposed in a side-by-side configuration. In the embodiment, the conducting wires include a first conducting wire 311, a second conducting wire 312, a third conducting wire 313, a fourth conducting wire 314, a fifth conducting wire 315, a sixth conducting wire 316, a seventh conducting wire 317, and an eighth conducting wire 318. It is noted that two ends of the conducting wire are respectively connected to the circuit modules 20A and 20B. In other words, the conducting wires can be extended to the circuit modules 20A/20B to form a circuit layout.

In practical applications, the circuit structure of the circuit module 20A/20B is a flexible circuit board, a rigid circuit board, an electrical kit, or any combination thereof. In the embodiment, the circuit module 20A is the flexible circuit board; the circuit module 20B is the rigid circuit board, but is not limited to the embodiment.

Figure 4:
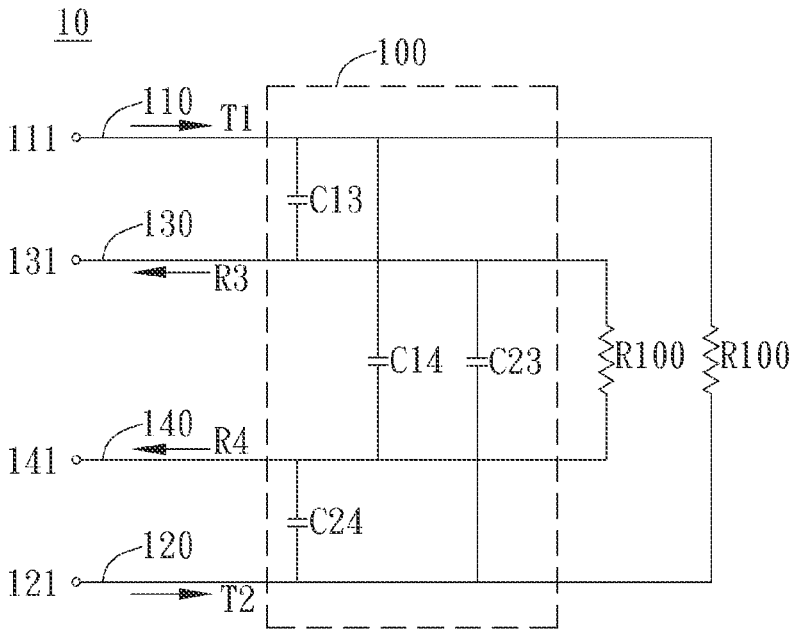
FIG. 4 is a schematic view of an embodiment of the electrical signals transmitted in the channels of the present invention.

In addition, please refer to FIG. 4; FIG. 4 is a schematic view of an embodiment of the electrical signals transmitted in the channels of the present invention. As shown in FIG. 4, the channels transmit a plurality of electrical signals and include a first channel 110, a second channel 120, a third channel 130, and a fourth channel 140, wherein each channel has an electrical connecting end. In the embodiment, the first channel 110 has a first electrical connecting end 111, the second channel 120 has a second electrical connecting end 121, the third channel 130 has a third electrical connecting end 131, and the fourth channel 140 has a fourth electrical connecting end 141. It is noted that a terminal unit R100 is connected with the third channel 130 and the fourth channel 140.

Please refer to FIG. 3 and FIG. 4; the electrical connecting ends are disposed in the body 30, and the electrical connecting ends of the first channel 110, the second channel 120, the third channel 130, and the fourth channel 140 are disposed according to a first sequence or a second sequence. In practical applications, the first sequence is the first channel 110, the third channel 130, the fourth channel 140, and the second channel 120, and the second sequence is the first channel 110, the second channel 120, the third channel 130, and the fourth channel 140. In the embodiment, the first channel 110 to the fourth channel 140 represent four channels arranged in the middle of the plurality of channels, but are not limited to the embodiment. In addition, the electrical connecting ends of the first channel 110 to the fourth channel 140 are disposed according to the first sequence, so that the first electrical connecting end 111 is disposed in the third conducting wire 313; the third electrical connecting end 131 is disposed in the fourth conducting wire 314; the fourth electrical connecting end 141 is disposed in the fifth conducting wire 315; and the second electrical connecting end 121 is disposed in the sixth conducting wire 316.

In other embodiments, the first channel 110 to the fourth channel 140 can be arbitrarily disposed according to other sequences. In addition, other channels can be selectively disposed in the sequences. For instance, the first channel 110 to the fourth channel 140 are disposed according to the first sequence, and one or more other channels can be disposed between the first channel 110 and the third channel 130. It is noted that the electrical signals in the first channel 110 and the electrical signals in the second channel 120 are differential signals, and the electrical signals in the third channel 130 and the electrical signals in the fourth channel 140 are differential signals.

It is noted that when each channel transmits the electrical signals, each channel generates at least one crosstalk coupling with the other channels. Please refer to FIG. 4; the channels in the connector circuit 10 have a crosstalk coupling region 100. In practical applications, the crosstalk coupling region 100 is formed in an electrical connector plug and includes crosstalk coupling capacitors C13, C14, C23, and C24. As shown in FIG. 4, the crosstalk coupling capacitor C13 exists between the first channel 110 and the third channel 130; the crosstalk coupling capacitor C14 exists between the first channel 110 and the fourth channel 140; the crosstalk coupling capacitor C23 exists between the second channel 120 and the third channel 130; the crosstalk coupling capacitor C24 exists between the second channel 120 and the fourth channel 140. It is noted that the crosstalk coupling affects the channels in the form of a coupling capacitor, such as the crosstalk coupling capacitors C13, C14, C23, and C24, wherein the crosstalk coupling capacitors C13, C14, C23, and C24 are not physical capacitors.

In the embodiment, the test signal T1 and the test signal T2 are differential signals. It is noted that when the test signal T1 and the test signal T2 are respectively transmitted in the first channel 110 and the second channel 120, the test signal T1 is respectively coupled to the third channel 130 and the fourth channel 140 through the crosstalk coupling capacitors C13/C14, and the test signal T2 is respectively coupled to the third channel 130 and the fourth channel 140 through the crosstalk coupling capacitors C23/C24, so that the third channel 130 and the fourth channel 140 respectively have a receiving signal R3 and a receiving signal R4. It is noted that when computing the crosstalk coupling value of each crosstalk coupling capacitor, only the test signals related to the channel are considered. For instance, the crosstalk coupling capacitors C13, C14, C23, and C24 respectively have the crosstalk couplings TC13, TC14, TC23, and TC24. Particularly, the correlation between the crosstalk coupling and the signals is respectively given as:

$$TC13=R3/T1|T2=0 \quad TC14=R4/T1|T2=0$$

$$TC23=R3/T2|T1=0 \quad TC24=R4/T2|T1=0$$

wherein, when computing the crosstalk coupling TC13, only the test signal T1 related to the first channel 110 is considered without considering the test signal T2 related to the second channel 120, and thus the test signal T2 is 0. Similarly, when computing the crosstalk coupling TC14, the test signal T2 is 0; computing the crosstalk coupling TC23 and TC24, the test signal T1 is 0.

It is noted that the crosstalk coupling TC13, TC14, TC23, and TC24 varies with frequency, and the crosstalk coupling between the channels is added as a crosstalk coupling sum CT:

$$\begin{aligned} CT &= TC13 + TC14 + TC23 + TC24 \\ &= (R3/T1 \mid T2 = 0) + (R4/T1 \mid T2 = 0) + (R3/T2 \mid T1 = 0) + \\ &\quad (R4/T2 \mid T1 = 0) \end{aligned}$$

wherein the test signal T1 and the test signal T2 are a pair of differential signals, assuming T=T1=−T2, then:

$$\begin{aligned} CT &= (R3/T \mid T2 = 0) + (R4/T \mid T2 = 0) - (R3/T \mid T1 = 0) - \\ &\quad (R4/T \mid T1 = 0) \\ &= (R3 \mid T2 = 0 + R4 \mid T2 = 0 - R3 \mid T1 = 0 - R4 \mid T1 = 0)/T \end{aligned}$$

In practical applications, when the crosstalk coupling sum CT=0, the signal transmission quality of the whole circuit will become better. In other words, $$(R3|T2=0)+(R4|T2=0)-(R3|T1=0)-(R4|T1=0)=0 \quad \text{(A)}$$

From equation (A), by simply decreasing the crosstalk coupling sum CT, the influence of the crosstalk coupling on the circuit will be decreased. It is noted that the present invention adjusts the value of the crosstalk coupling sum to enhance the signal transmission quality without decreasing the individual crosstalk coupling magnitude.

From equation (A), it is given that:

$$(R3|T2=0)-(R3|T1=0)=0 \quad \text{(B); and}$$

$$(R4|T2=0)-(R4|T1=0)=0 \quad \text{(C)}$$

In other words, when both of equations (B) and (C) are true, the crosstalk coupling sum CT will be 0. It is noted that from equations (B) and (C), by adjusting the difference of the crosstalk coupling C13 and the crosstalk coupling C23 to be 0 and adjusting the difference of the crosstalk coupling C14 and the crosstalk coupling C24 to be 0, the crosstalk coupling sum CT can be reduced.

Figure 5:
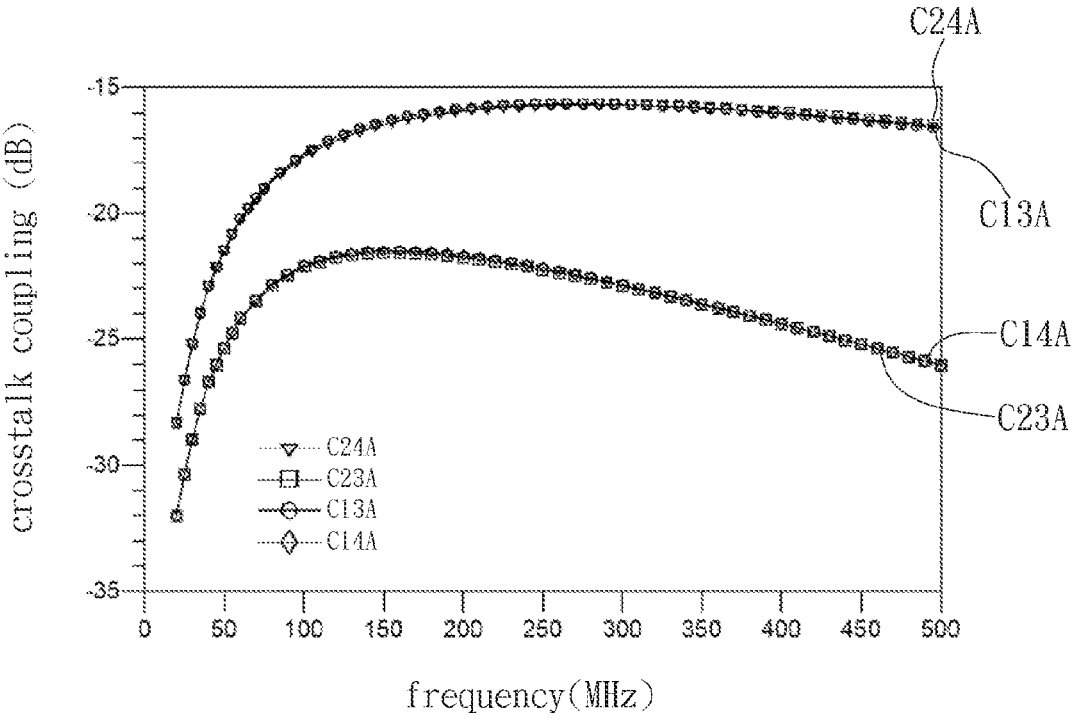
FIG. 5 is a diagram of the crosstalk-coupling-to-frequency of the present invention.

Please refer to FIG. 5; FIG. 5 is a diagram of the crosstalk-coupling-to-frequency of the present invention, wherein the crosstalk coupling TC13 has a crosstalk-coupling-to-frequency curve C13A; the crosstalk coupling TC23 has a crosstalk-coupling-to-frequency curve C23A; the crosstalk coupling TC14 has a crosstalk-coupling-to-frequency curve C14A; the crosstalk coupling TC24 has a crosstalk-coupling-to-frequency curve C24. As shown in equations (B) and (C), the crosstalk coupling sum approaches to 0 when the crosstalk-coupling-to-frequency curves C13A/C23A/C14A/C24A are overlapped to each other. In practical applications, the difference between the crosstalk coupling TC13 and the crosstalk coupling TC23 is 0 when the crosstalk-coupling-to-frequency curves C13A/C23A are overlapped to each other, that is, the result of equation (B). In addition, the difference between the crosstalk coupling TC14 and the crosstalk coupling TC24 is 0 when the crosstalk-coupling-to-frequency curves C14A/C24A are overlapped to each other, that is, the result of equation (C).

Figure 6:
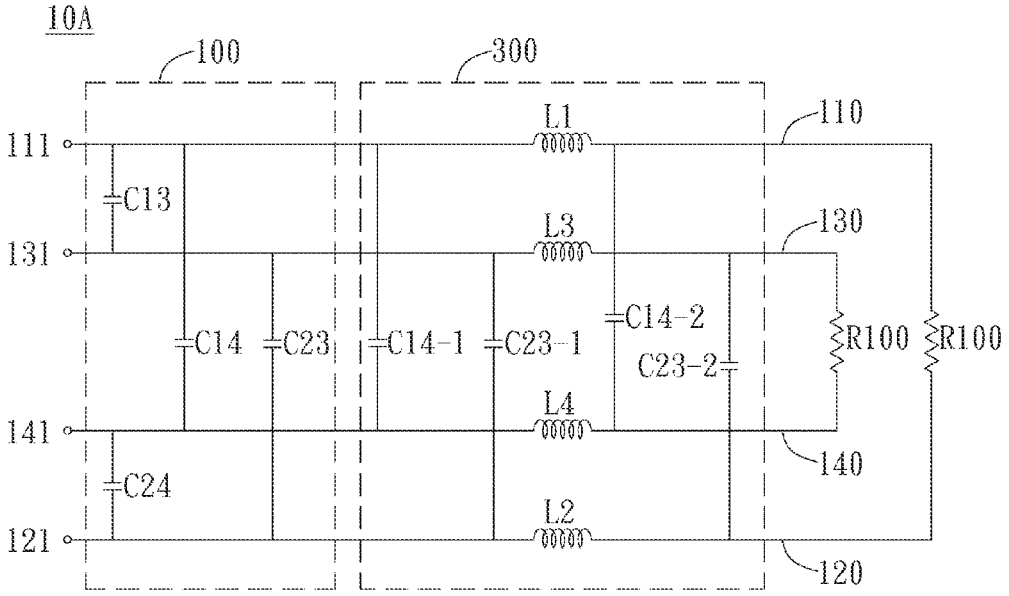
FIG. 6 is a schematic view of the circuit of the electrical connector of the present invention.

Please refer to FIG. 6; FIG. 6 is a schematic view of the circuit of the electrical connector of the present invention. As shown in the connector circuit 10A of FIG. 6, the electrical connector includes at least one filter unit, wherein the at least one filter unit is connected with the channels 110 to 140 and includes at least one first filter unit (e.g. first filter units L1 to L4) and at least one second filter unit (e.g. filter units C14-1/C14-2/C23-1/C23-2), wherein the first filter units L1/L4 and the second filter units C14-1/C14-2 are connected with the first channel 110 and the fourth channel 140 to form a first modulation module. In addition, the first filter units L2/L3 and the second filter units C23-1/C23-2 are connected with the second channel 120 and the third channel 130 to form a second modulation module. It is noted that the at least one filter unit is a capacitor, an inductor, a resistor, or other electrical components. In practical applications, the electrical connector utilizes different electrical components to form the connector circuit 10A having filter feature, further decreasing the influence of the crosstalk coupling.

In the embodiment, each modulation module (the first modulation module or the second modulation module) includes at least one filter unit, wherein each filter unit is connected with the conducting wires in series or in parallel, and at least one filter unit and the at least one circuit module 20A/20B form the at least one modulation module. For instance, as shown in FIG. 6, the first filter unit L1 and the first filter unit L4 are respectively connected with the first channel 110 and the fourth channel 140 in series, and the second filter unit C14-1 and the second filter unit C14-2 are respectively connected with the first channel 110 and the fourth channel 140 in parallel, so that the first filter units L1/L4, the second filter unit C14-1/C14-2, the first channel 110, and the fourth channel 140 together form the first modulation module. The first filter unit L2 and the first filter unit L3 are respectively connected with the second channel 120 and the third channel 130 in series, and the second filter unit C23-1 and the second filter unit C23-2 are respectively connected with the second channel 120 and the third channel 130 in parallel, so that the first filter units L2/L3, the second filter unit C23-1/C23-2, the second channel 120, and the third channel 130 together form the second modulation module. It is noted that the filter unit or each modulation module adjusts the crosstalk coupling to decrease the crosstalk coupling sum according to the relation between the crosstalk coupling and the other crosstalk couplings.

It is noted that the first filter units L1 to L4 are inductors, and the first filter unit decreases the at least one crosstalk coupling in high frequency. For instance, the first filter unit L1 can decrease the effect of the crosstalk coupling capacitor C13 or the crosstalk coupling capacitor C14 in high frequency, and can combine the other filter units according to practical requirements to decrease the crosstalk coupling sum. In practical applications, the first filter units L1 to L4 of the electrical connector 1 can be formed by twisting the conducting wire or extending the conducting wire. In the embodiment, the first filter units L1 to L4 are respectively connected with the conducting wires of the body 30 in series.

In addition, the second filter units C14-1/C14-2/C23-1/C23-2 are capacitors, and the second filter unit decreases the at least one crosstalk coupling in low frequency. In practical applications, the second filter unit C14-1 can decrease the effect of the crosstalk coupling capacitor C14 in low frequency, and can combine the other filter units according to practical requirements to decrease the crosstalk coupling sum. In practical applications, the at least one filter unit of the electrical connector 1 can be formed by overlapping the cross sections of the conducting wires. In the embodiment, the second filter units C14-1 and C23-1 are disposed in the circuit module 20A; and the second filter units C14-2 and C23-2 are disposed in the circuit module 20B.

In other embodiments (not shown), the filter unit is a resistor, and the filter unit of the electrical connector can be formed by increasing the length of the conducting wire 310 or decreasing the area of the cross section of the conducting wire. In addition, the at least one modulation module and the channels form at least one of a T-type filter and a π-type filter, but is not limited to the embodiment.

As shown in FIG. 6, the circuit structure has the crosstalk coupling region 100, the third modulation module 300, and a plurality of terminal units R100, wherein the terminal unit R100 can be a terminal resistor. In the embodiment, the crosstalk coupling region 100 is formed in the plug of the electrical connector. The third modulation module 300 has the first filter units and the second filter unit to adjust the crosstalk coupling, further decreasing the crosstalk coupling sum.

Figure 7:
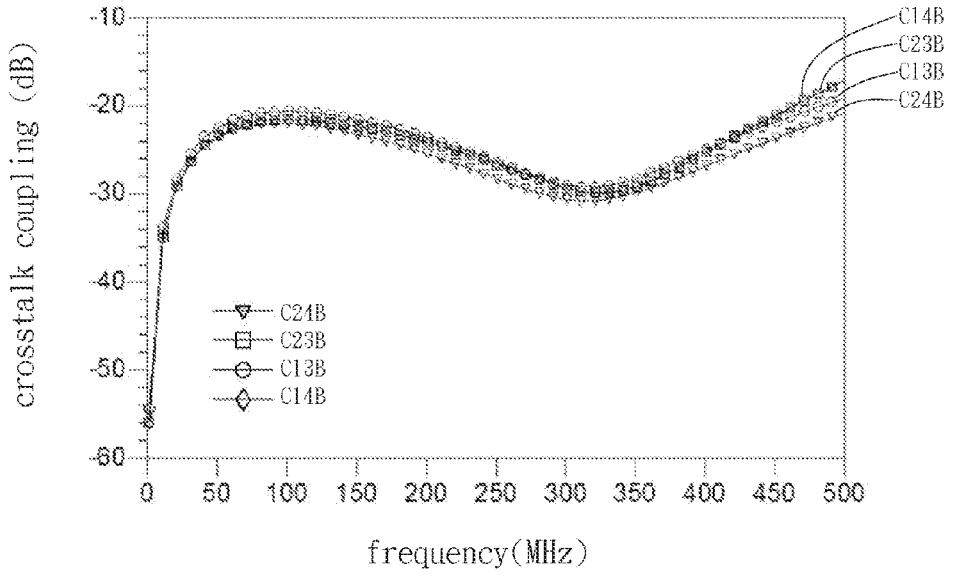
FIG. 7 is a diagram of the crosstalk-coupling-to-frequency of the present invention.

Please refer to FIG. 7; FIG. 7 is a diagram of the crosstalk-coupling-to-frequency of the present invention. It is noted that the crosstalk-coupling-to-frequency curves of FIG. 7 are obtained by utilizing the filter units of the connector circuit 10A in FIG. 6 to improve the crosstalk coupling phenomenon. Compared to the non-overlapping relation of the crosstalk-coupling-to-frequency curve C13A and the crosstalk-coupling-to-frequency curve C23A in FIG. 5, the crosstalk-coupling-to-frequency curves C13B and C23B approach to be overlapped to each other. That is, the difference between the crosstalk coupling TC13 and the crosstalk coupling TC23 approaches to 0. In addition, the crosstalk-coupling-to-frequency curves C14B and C24B approach to be overlapped to each other. In other words, the difference between the crosstalk coupling TC14 and the crosstalk coupling TC24 approaches to 0. In other words, because the crosstalk-coupling-to-frequency curves C13B/C23B/C14B/C24B are almost overlapped to each other, the crosstalk coupling sum approaches to 0, further decreasing the crosstalk coupling.

Figure 8A:
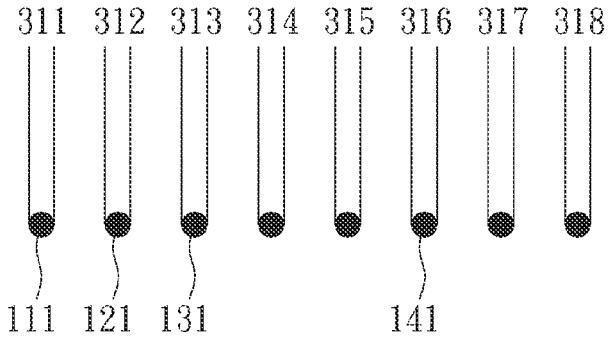
FIG. 8A is a schematic view of the channels arranged according to the second sequence of the present invention.

In addition, please refer to FIG. 8A; FIG. 8A is a schematic view of the channels arranged according to the second sequence of the present invention. As shown in FIG. 8A, when the electrical connecting ends of the first channel 110 to the fourth channel 140 are disposed according to the second sequence (i.e. the first channel 110, the second channel 120, the third channel 130, and the fourth channel 140), the first electrical connecting end 111 can be disposed in the first conducting wire 311; the second electrical connecting end 121 can be disposed in the second conducting wire 312; the third electrical connecting end 131 can be disposed in the third conducting wire 313; the fourth electrical connecting end 141 can be disposed in the sixth conducting wire 316.

It is noted that the electrical connecting ends of the first channel 110 to the fourth channel 140 are disposed in the conducting wires according to the second sequence, and other conducting wires can be arbitrarily interposed in the sequence. As shown in FIG. 8A, the fourth conducting wire 314 and the fifth conducting wire 315 are disposed between the third electrical connecting end 131 and the fourth electrical connecting end 141, and the first electrical connecting end 111, the second electrical connecting end 121, the third electrical connecting end 131, and the fourth electrical connecting end 141 are disposed according to the second sequence. It is noted that the electrical signals transmitted in the first channel 110 and the second channel 120 respectively corresponding to the first electrical connecting end 111 and the second electrical connecting end 121 are a pair of differential signals. The electrical signals transmitted in the third channel 130 and the fourth channel 140 respectively corresponding to the third electrical connecting end 131 and the fourth electrical connecting end 141 are another pair of differential signals.

Figure 8B:
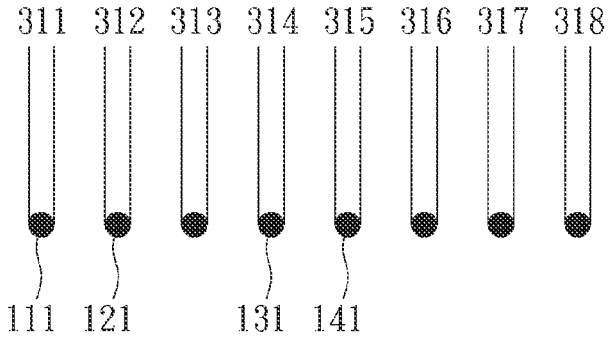
FIG. 8B is another schematic view of the channels arranged according to the second sequence of the present invention.

Please refer to FIG. 8B; FIG. 8B is a schematic view of the channels arranged according to the second sequence of the present invention. As shown in FIG. 8B; the first electrical connecting end 111 can be disposed in the first conducting wire 311; the second electrical connecting end 121 is disposed in the second conducting wire 312; the third electrical connecting end 131 is disposed in the fourth conducting wire 314, and the fourth electrical connecting end 141 is disposed in the fifth conducting wire 315. In addition, the third conducting wire 313 is disposed between the second electrical connecting end 121 and the third electrical connecting end 131, while the first electrical connecting end 111, the second electrical connecting end 121, the third electrical connecting end 131, and the fourth electrical connecting end 141 are disposed according to the second sequence. It is noted that the electrical signals transmitted in the first channel 110 and the second channel 120 respectively corresponding to the first electrical connecting end 111 and the second electrical connecting end 121 are a pair of differential signals, and the electrical signals transmitted in the third channel 130 and the fourth channel 140 respectively corresponding to the third electrical connecting end 131 and the fourth electrical connecting end 141 are another pair of differential signals.

Figure 8C:
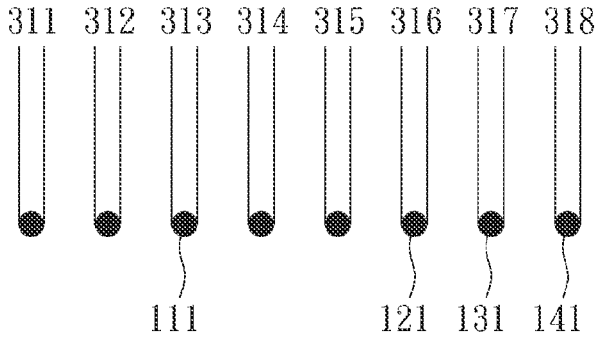
FIG. 8C is another schematic view of the channels arranged according to the second sequence of the present invention.

Please refer to FIG. 8C; FIG. 8C is a schematic view of the channels arranged according to the second sequence of the present invention. As shown in FIG. 8C; the first electrical connecting end 111 can be disposed in the third conducting wire 313; the second electrical connecting end 121 is disposed in the sixth conducting wire 316; the third electrical connecting end 131 is disposed in the seventh conducting wire 317; the fourth electrical connecting end 141 is disposed in the eighth conducting wire 318. In addition, the fourth conducting wire 314 and the fifth conducting wire 315 are disposed between the first electrical connecting end 111 and the second electrical connecting end 121, while the first electrical connecting end 111, the second electrical connecting end 121, the third electrical connecting end 131, and the fourth electrical connecting end 141 are disposed according to the second sequence. It is noted that the electrical signals transmitted in the first channel 110 and the second channel 120 respectively corresponding to the first electrical connecting end 111 and the second electrical connecting end 121 are a pair of differential signals, and the electrical signals transmitted in the third channel 130 and the fourth channel 140 respectively corresponding to the third electrical connecting end 131 and the fourth electrical connecting end 141 are the other pair of differential signals.

Figure 8D:
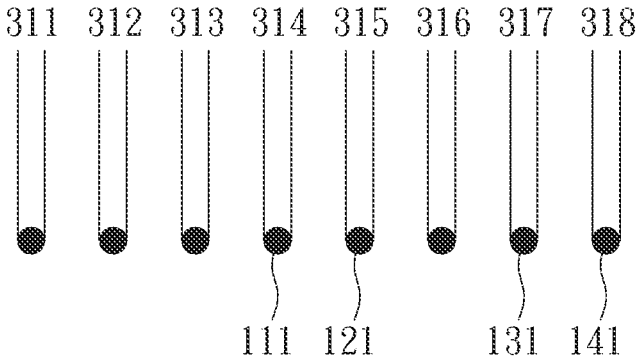
FIG. 8D is another schematic view of the channels arranged according to the second sequence of the present invention.

Please refer to FIG. 8D; FIG. 8D is a schematic view of the channels arranged according to the second sequence of the present invention. As shown in FIG. 8D; the first electrical connecting end 111 can be disposed in the fourth conducting wire 314; the second electrical connecting end 121 is disposed in the fifth conducting wire 315; the third electrical connecting end 131 is disposed in the seventh conducting wire 317, and the fourth electrical connecting end 141 is disposed in the eighth conducting wire 318. In addition, the sixth conducting wire 316 is disposed between the second electrical connecting end 121 and the third electrical connecting end 131, while the first electrical connecting end 111, the second electrical connecting end 121, the third electrical connecting end 131, and the fourth electrical connecting end 141 are disposed according to the second sequence.

Figure 8E:
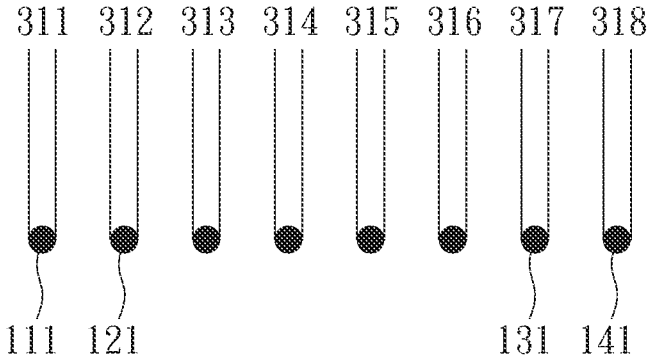
FIG. 8E is another schematic view of the channels arranged according to the second sequence of the present invention.

Please refer to FIG. 8E; FIG. 8E is a schematic view of the channels arranged according to the second sequence of the present invention. As shown in FIG. 8E; the first electrical connecting end 111 can be disposed in the first conducting wire 311; the second electrical connecting end 121 is disposed in the second conducting wire 312; the third electrical connecting end 131 is disposed in the seventh conducting wire 317, and the fourth electrical connecting end 141 is disposed in the eighth conducting wire 318. In addition, the third conducting wire 313 to the sixth conducting wire 316 are disposed between the second electrical connecting end 121 and the third electrical connecting end 131, while the first electrical connecting end 111, the second electrical connecting end 121, the third electrical connecting end 131, and the fourth electrical connecting end 141 are disposed according to the second sequence.

Figure 9:
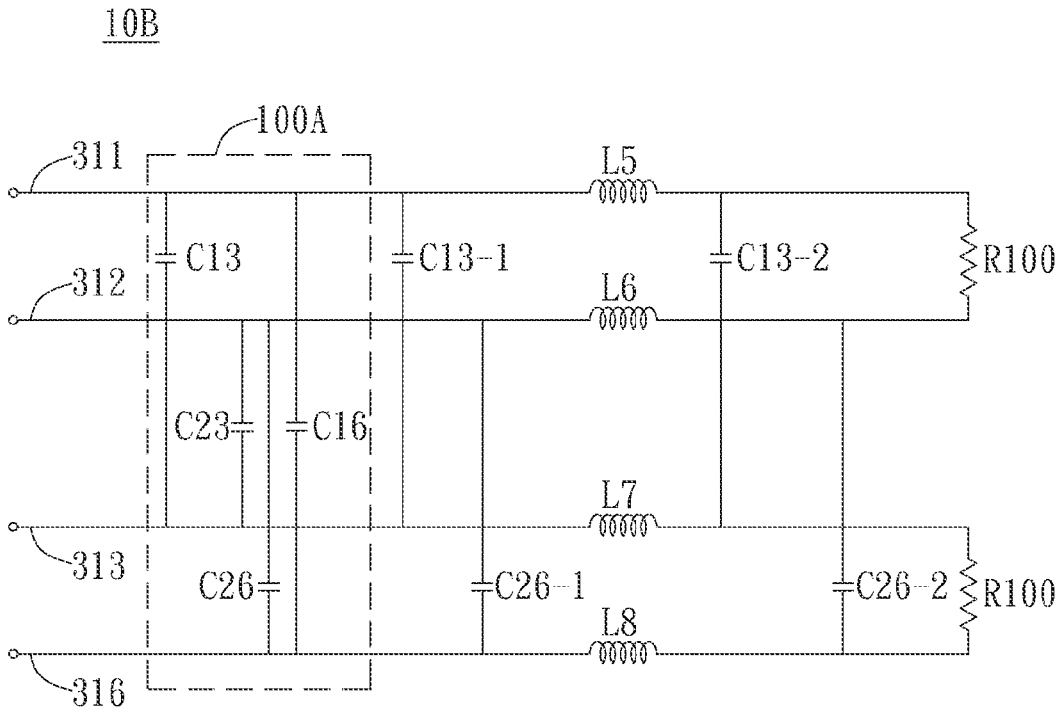
FIG. 9 is a schematic view of another embodiment of the circuit of the electrical connector of the present invention.

Please refer to FIG. 9; FIG. 9 is a schematic view of an embodiment of the circuit of the electrical connector of the present invention. It is noted that the connector circuit 10B in FIG. 9 is disposed according to the sequence in FIG. 8A, wherein connector circuit 10B has a crosstalk coupling region 100A. The crosstalk coupling region 100A is formed through the crosstalk coupling capacitors C13, C16, C23, and C26. In addition, the first filter units L5 to L8 are respectively disposed on the first conducting wire 311, the second conducting wire 312, the third conducting wire 313, and the sixth conducting wire 316. The second filter units C13-1/C13-2 are disposed between the first conducting wire 311 and the third conducting wire 313; the second filter units C26-1/C26-2 are disposed between the second conducting wire 312 and the sixth conducting wire 316. In practical applications, the second filter units C13-1 and C13-2 filter the crosstalk coupling capacitor C13; the second filter units C26-1 and C26-2 filter the crosstalk coupling capacitor C26. It is noted that, in other embodiments, the filter units can be selectively disposed in the circuit structure of FIG. 3 or/and FIG. 8B-8E, not limited to the embodiment.

Figure 10:
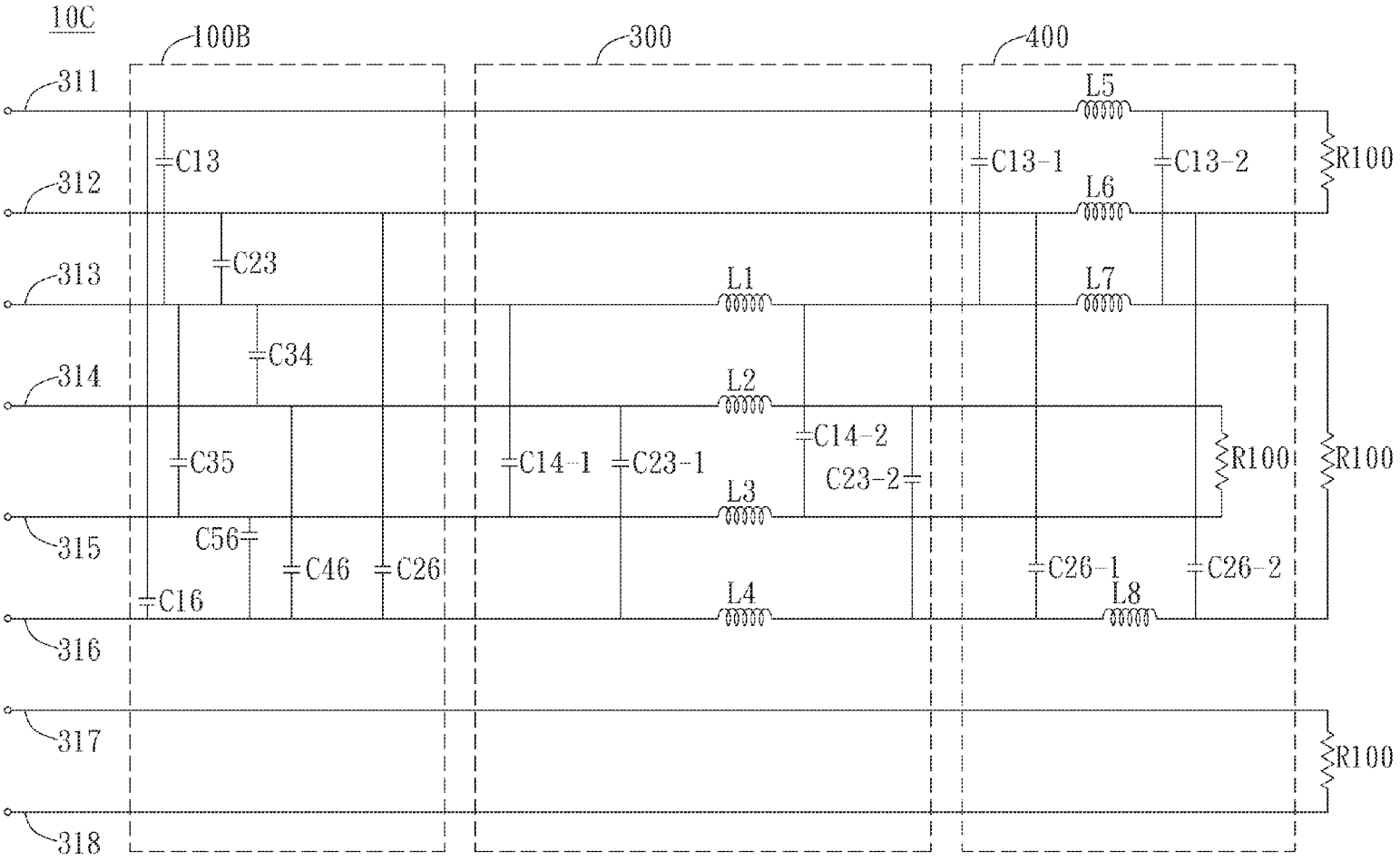
FIG. 10 is a schematic view of another embodiment of the circuit of the electrical connector of the present invention.

Please refer to FIG. 10; FIG. 10 is a schematic view of an embodiment of the circuit of the electrical connector of the present invention. It is noted that the connector circuit 10C shown in FIG. 10 is the circuit structure combined from the filter units of FIG. 3 and FIG. 9. As shown in FIG. 10, the connector circuit 10C has a crosstalk coupling region 100B, a third modulation module 300, and the fourth modulation module 400, wherein the third modulation module 300 is the circuit structure shown in FIG. 6, and the fourth modulation module 400 is the circuit structure shown in FIG. 9. In the embodiment, the crosstalk coupling region 100B has the crosstalk coupling capacitors C13, C16, C23, C34, C35, C26, C46, and C56, wherein the crosstalk coupling capacitor C13 is formed between the first conducting wire 311 and the third conducting wire 313; the crosstalk coupling capacitor C16 is formed between the first conducting wire 311 and the sixth conducting wire 316; the crosstalk coupling capacitor C23 is formed between the second conducting wire 312 and the third conducting wire 313; the crosstalk coupling capacitor C34 is formed between the third conducting wire 313 and the fourth conducting wire 314; the crosstalk coupling capacitor C35 is formed between the third conducting wire 313 and the fifth conducting wire 315; the crosstalk coupling capacitor C26 is formed between the second conducting wire 312 and the sixth conducting wire 316; the crosstalk coupling capacitor C46 is formed between the fourth conducting wire 314 and the sixth conducting wire 316; the crosstalk coupling capacitor C56 is formed between the fifth conducting wire 315 and the sixth conducting wire 316. In addition, the third modulation module 300 and the fourth modulation module 400 are connected with the first conducting wire 311 to the eighth conducting wire 318 according to the relation between the crosstalk couplings and other crosstalk couplings, further decreasing the crosstalk coupling sum.

Figure 11:
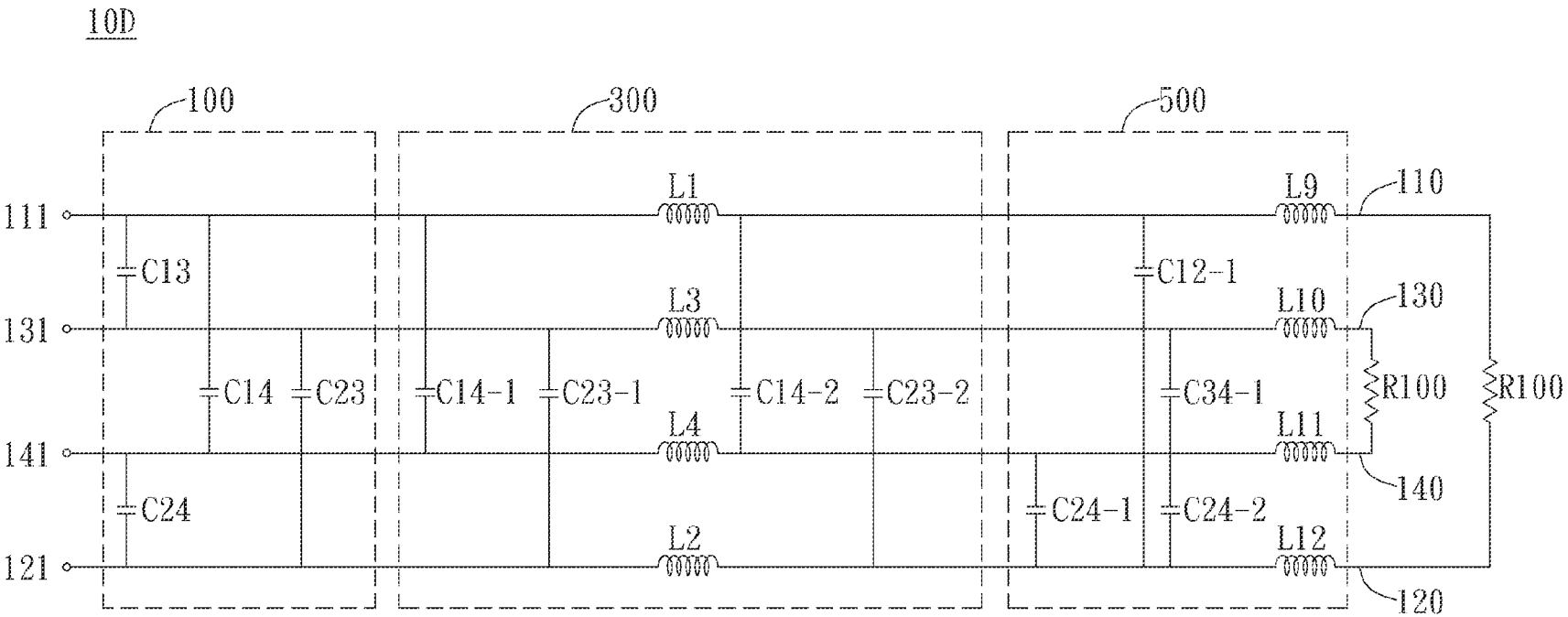
FIG. 11 is a schematic view of another embodiment of the circuit of the electrical connector of the present invention.

Please refer to FIG. 11; FIG. 11 is a schematic view of the embodiment of the circuit of the electrical connector of the present invention. It is noted that the connector circuit 10D shown in FIG. 11 is the advanced circuit of the connector circuit 10A in FIG. 6. As shown in FIG. 11, compared to the connector circuit 10A, the connector circuit 10D further includes the fifth modulation module 500. In the embodiment, the fifth modulation module 500 includes the first filter units L9 to L12 and the second filter units C12-1, C24-1, C24-2, and C34-1, wherein the first filter units L9 to L12 are respectively connected with the first channel 110 to the fourth channel 140 in series; the second filter units C24-1 and C24-2 are connected between the second channel 120 and the fourth channel 140 in parallel; the second filter unit C12-1 is connected between the first channel 110 and the second channel 120 in parallel, and the second filter unit C34-1 is connected between the third channel 130 and the fourth channel 140 in parallel.

Figure 12:
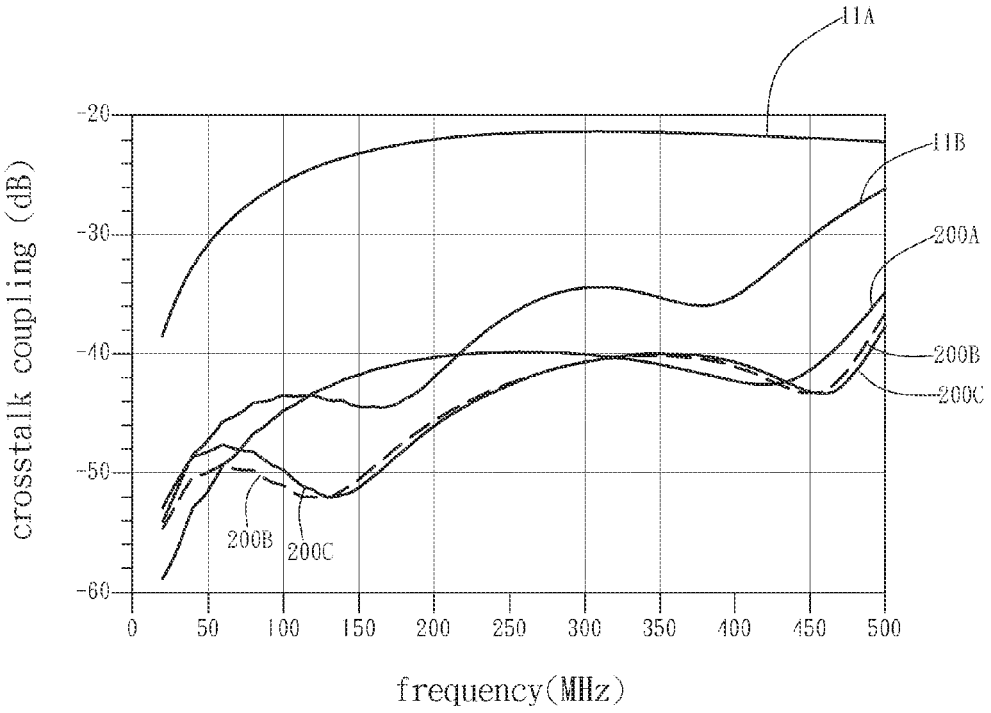
FIG. 12 is a diagram of the crosstalk-coupling-to-frequency of the present invention.

Please refer to FIG. 12; FIG. 12 is a diagram of the crosstalk-coupling-to-frequency of the present invention. As shown in FIG. 12, curve 200A represents the crosstalk coupling magnitude of the connector circuit 10A in FIG. 6, and curve 200B represents the crosstalk coupling magnitude of the connector circuit 10D. Compared to the compensated crosstalk coupling magnitude 11B, the connector circuit 10A can uniformly decrease the crosstalk coupling magnitude of the circuit over the full frequency range, especially having an obvious effect in high frequency of 250 MHz~500 MHz. In addition, compared to the connector circuit 10A, the fifth modulation module 500 of the connector circuit 10D decreases the crosstalk coupling magnitude much more in 75 MHz~350 MHz and 450 MHz~500 MHz.

Figure 13:
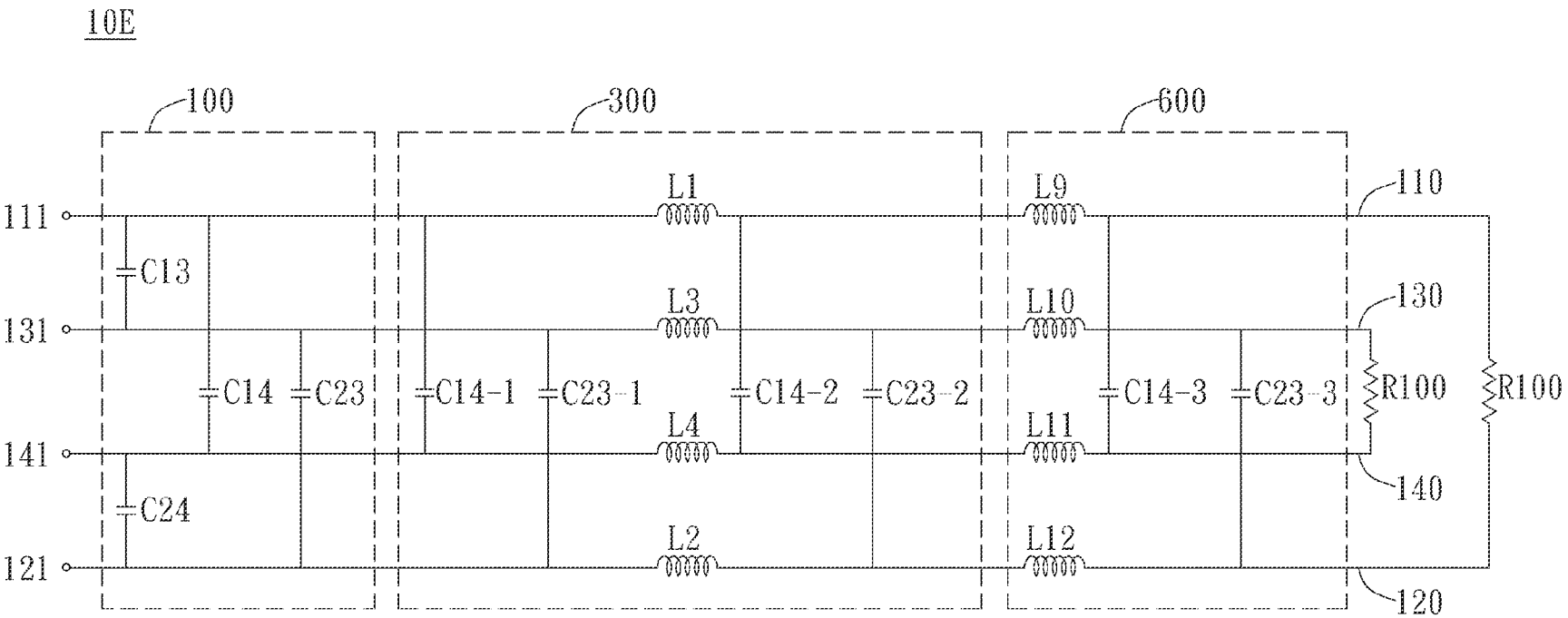
FIG. 13 is a schematic view of another embodiment of the circuit of the electrical connector of the present invention.

In addition, please refer to FIG. 13; FIG. 13 is a schematic view of the embodiment of the circuit of the electrical connector of the present invention. It is noted that the connector circuit 10E shown in FIG. 13 is another advanced circuit of the connector circuit 10A in FIG. 6. As shown in FIG. 13, compared to the connector circuit 10A, the connector circuit 10E further includes the sixth modulation module 600. In the embodiment, the sixth modulation module 600 includes the first filter units L9 to L12 and the second filter units C14-3 and C23-3, wherein the first filter units L9 to L12 are respectively connected with the first channel 110 to the fourth channel 140 in series; the second filter unit C14-3 is connected between the first channel 110 and the fourth channel 140 in parallel, and the second filter unit C23-3 is connected between the second channel 120 and the third channel 130 in parallel.

As shown in FIG. 12, 200C is the crosstalk coupling magnitude of the connector circuit 10E. It is noted that, compared to the connector circuit 10D in FIG. 11, the connector circuit 10E utilizes less filter units to provide a similar effect. It is noted that, especially in high frequency of 450 MHz~500 MHz, the crosstalk coupling magnitude 200C is less than the crosstalk coupling magnitude 200B, hence the connector circuit 10E in FIG. 13 can have the advantage of decreasing the crosstalk coupling in high frequency at lower cost.

Compared to prior arts, the electrical connector of the present invention utilizes the at least one filter unit or the least one modulation module connected to the channels and disposed in the circuit according to the relative relation between the crosstalk coupling and other crosstalk couplings, further decreasing the effect of the crosstalk couplings. In practical applications, the at least one filter unit or the at least one modulation module not only effectively decreases the crosstalk coupling in low frequency, but also has an obvious effect in high frequency. In addition, the modified circuit embodiment further discloses that the present invention has the advantage of low cost and enhanced transmission quality.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An electrical connector, comprising:

a plurality of channels transmitting a plurality of electrical signals, wherein each channel generates at least one crosstalk coupling with the other channels, the at least one crosstalk coupling varies with frequency, and the at least one crosstalk coupling between the channels is added as a crosstalk coupling sum; and at least one modulation module, wherein each modulation module is connected with the channels, and the at least one modulation module adjusts the at least one crosstalk coupling to decrease the crosstalk coupling sum according to the relation between the at least one crosstalk coupling and the other crosstalk couplings.

2. The electrical connector of claim 1, wherein each crosstalk coupling has at least one crosstalk-coupling-to-frequency curve, and when the crosstalk-coupling-to-frequency curves are overlapped to each other, the crosstalk coupling sum approaches to 0.

3. The electrical connector of claim 1, further comprising:

at least one circuit module connected with the channels; and a body connected with the at least one circuit module and comprising a plurality of conducting wires, wherein the channels are disposed in the conducting wires.

4. The electrical connector of claim 3, wherein the at least one modulation module comprises:

at least one filter unit, wherein each filter unit is connected with the conducting wires in series or in parallel, and the at least one filter unit and the at least one circuit module form the at least one modulation module.

5. The electrical connector of claim 4, wherein the at least one filter unit is a capacitor, an inductor, a resistor, or other electrical components.

6. The electrical connector of claim 4, wherein the at least one filter unit is an inductor, and the at least one filter unit decreases the at least one crosstalk coupling in high frequency.

7. The electrical connector of claim 4, wherein the at least one filter unit is a capacitor, and cross-sections of the conducting wires are overlapped to form the at least one filter unit, wherein the at least one filter unit decreases the at least one crosstalk coupling in low frequency.

8. The electrical connector of claim 4, wherein the at least one filter unit is a resistor, and the length of the conducting wire is increased or the cross-section area of the conducting wire is decreased to form the at least one filter unit.

9. The electrical connector of claim 3, wherein the circuit structure of the at least one circuit module is a flexible circuit board, a rigid circuit board, an electrical kit, or any combination thereof.

10. The electrical connector of claim 1, wherein the at least one modulation module and the channels form at least one of a T-type filter and a $\pi$-type filter.

11. An electrical connector, comprising:

a plurality of channels transmitting a plurality of electrical signals and comprising a first channel, a second channel, a third channel, and a fourth channel, wherein each channel generates at least one crosstalk coupling with the other channels, the at least one crosstalk coupling varies with frequency and has an electrical connecting end, and the at least one crosstalk coupling between the channels is added as a crosstalk coupling sum; and at least one filter unit connected with the channels and comprising at least one first filter unit and at least one second filter unit, wherein the at least one first filter unit and the at least one second filter unit are connected to the first channel and the fourth channel to form a first modulation module, the at least one first filter unit and the at least one second filter unit are connected to the second channel and the third channel to form a second modulation module, and the at least one filter unit adjusts the at least one crosstalk coupling to decrease the crosstalk coupling sum according to the relation between the at least one crosstalk coupling and the other crosstalk couplings;

wherein the electrical connecting ends of the first channel, the second channel, the third channel, and the fourth channel are disposed according to a first sequence or a second sequence.

12. The electrical connector of claim 11, wherein the first sequence is the first channel, the third channel, the fourth channel, and the second channel.

13. The electrical connector of claim 11, wherein the second sequence is the first channel, the second channel, the third channel, and the fourth channel.

14. The electrical connector of claim 11, wherein the electrical signals in the first channel and the electrical signals in the second channel are differential signals; and the electrical signals in the third channel and the electrical signals in the fourth channel are differential signals.

15. The electrical connector of claim 11, wherein each crosstalk coupling has at least one crosstalk-coupling-to-frequency curve, and when the crosstalk-coupling-to-frequency curves are overlapped to each other, the crosstalk coupling sum approaches to 0.

16. The electrical connector of claim 11, wherein the at least one filter unit and the channels form at least one of a T-type filter and a π-type filter.

17. The electrical connector of claim 11, wherein the at least one filter unit is a capacitor, an inductor, a resistor, or other electrical components.

18. The electrical connector of claim 17, wherein the at least one first filter unit is the inductor, and the at least one first filter unit decreases the at least one crosstalk coupling in high frequency.

19. The electrical connector of claim 17, wherein the at least one second filter unit is the capacitor, and the at least one second filter unit decreases the at least one crosstalk coupling in low frequency.

* * * * *